US008491351B2

(12) United States Patent
Trzecieski

(10) Patent No.: US 8,491,351 B2
(45) Date of Patent: Jul. 23, 2013

(54) TOY VEHICLE HAVING SMOKING TIRE FUNCTION

(76) Inventor: Michael Trzecieski, Hong Kong (HK)

( * ) Notice: Subject to any disclaimer, the term of this patent is extended or adjusted under 35 U.S.C. 154(b) by 586 days.

(21) Appl. No.: 12/500,626

(22) Filed: Jul. 10, 2009

(65) Prior Publication Data

US 2010/0009591 A1 Jan. 14, 2010

Related U.S. Application Data

(60) Provisional application No. 61/079,439, filed on Jul. 10, 2008.

(51) Int. Cl.
*A63H 17/36* (2006.01)

(52) U.S. Cl.
USPC ..... 446/468; 446/437; 446/456; 446/460; 446/465; 446/466

(58) Field of Classification Search
USPC ..... 446/438, 437, 456, 460, 465, 466, 446/468
See application file for complete search history.

(56) References Cited

U.S. PATENT DOCUMENTS

| | | | | | |
|---|---|---|---|---|---|
| 2,124,302 | A * | 7/1938 | Lohr et al. | ..... | 446/436 |
| RE26,563 | E * | 4/1969 | Seuthe | ..... | 446/25 |
| 3,844,557 | A * | 10/1974 | Pompetti | ..... | 463/58 |
| 4,303,397 | A * | 12/1981 | Swiatosz | ..... | 434/226 |
| 4,556,397 | A * | 12/1985 | Arad et al. | ..... | 446/436 |
| 4,596,534 | A * | 6/1986 | Ishimoto | ..... | 446/466 |
| 4,846,758 | A * | 7/1989 | Chou | ..... | 446/437 |
| 4,871,115 | A * | 10/1989 | Hessey | ..... | 239/136 |
| 5,131,880 | A * | 7/1992 | Nesbit et al. | ..... | 446/180 |
| 5,312,281 | A * | 5/1994 | Takahashi et al. | ..... | 446/25 |
| 5,361,705 | A * | 11/1994 | Powell | ..... | 104/60 |
| 5,512,001 | A * | 4/1996 | Kent et al. | ..... | 446/25 |
| 6,632,122 | B2 * | 10/2003 | Klitsner et al. | ..... | 446/484 |
| 6,676,473 | B2 * | 1/2004 | Pierson et al. | ..... | 446/25 |
| 2005/0227575 | A1 * | 10/2005 | Pierson | ..... | 446/93 |

* cited by examiner

*Primary Examiner* — Gene Kim
*Assistant Examiner* — Joseph B Baldori

(57) ABSTRACT

The embodiments of the invention provide for a toy vehicle having a smoking tire function where during play of the toy vehicle the simulated smoke gives the toy vehicle an appearance of the toy vehicle performing a burnout, such as that which is seen as being performed by high horse powered drift cars, where the simulated smoke is generated by heating of a smoke fluid or through a water fogger. In either case the simulated smoke is released proximate the at least a wheel thereof to give the toy vehicle an appearance of having smoking tires.

12 Claims, 5 Drawing Sheets

TOY VEHICLE HAVING SMOKING TIRE FUNCTION

CROSS REFERENCE TO RELATED APPLICATION

This application benefits from the priority of U.S. Provisional Applications 61/079,439 filed on Jul. 10, 2008, which is incorporated herein by reference.

BACKGROUND

1. Field of the Invention

The field of invention relates generally to toys and more specifically to remote controlled toys.

2. Background Information

In the toy industry these days it is becoming more difficult to innovate creative toys. Remote control (RC) vehicles are always a favorite amongst kids and some adults. However, having a remote control car toy that only drives has limited play value. Ideally it also performs other functions to entertain the user. A toy smoke generating vehicle is known in the art, such as U.S. Pat. No. 5,512,001, which is incorporated herein by reference, however this vehicle only discharges a puff of smoke through its exhaust pipe.

Ultrasonic water foggers or ultrasonic humidifiers are also known in the art. These utilize a high frequency vibrating element to create mist from water, which resembles a fog, which in some cases can resemble smoke.

The motor vehicle sport of drifting has also gained much popularity in recent years, where high horse powered vehicles drive around a track and smoke their tires as they race in front of an audience. Unfortunately, in order to smoke the tires, a lot of horsepower is required for the tires to break contact with the ground to free spin and to burn.

It is therefore an object of the invention to provide a method and apparatus that provides additional play value to an RC vehicle.

SUMMARY OF THE INVENTION

In accordance with the invention there is provided a toy vehicle comprising: a body; at least a wheel rotationally coupled for rotating with respect to the body; a motor coupled between the at least a wheel and the body for rotating the at least a wheel with respect to the body; an exhaust tube having an aperture disposed proximate the at least a wheel; and, a smoke generating unit fluidly coupled with the exhaust tube for generating simulated smoke wherein the simulated smoke exits the exhaust tube at the aperture and proximate the at least a wheel.

In accordance with the invention there is provided a method comprising: providing a toy vehicle having a body providing at least a wheel rotationally coupled with the body; providing an exhaust tube having an aperture disposed proximate the at least a wheel; and, controllably generating simulated smoke for being exhausted from the aperture of the exhaust tube proximate the at least a wheel.

In accordance with the invention there is provided a method comprising: providing a toy vehicle having a body providing four wheels rotationally coupled with the body; providing an exhaust tube having an aperture disposed proximate at least one of the four wheels; controllably generating simulated smoke for being exhausted from the aperture of the exhaust tube proximate at least one of the four wheels; providing a fifth wheel for operating in a first mode of operation and a second mode of operation.

BRIEF DESCRIPTION OF THE DRAWINGS

Exemplary embodiments of the invention will now be described in conjunction with the following drawings, in which.

DESCRIPTION OF EMBODIMENTS OF THE INVENTION

Figure 1A:
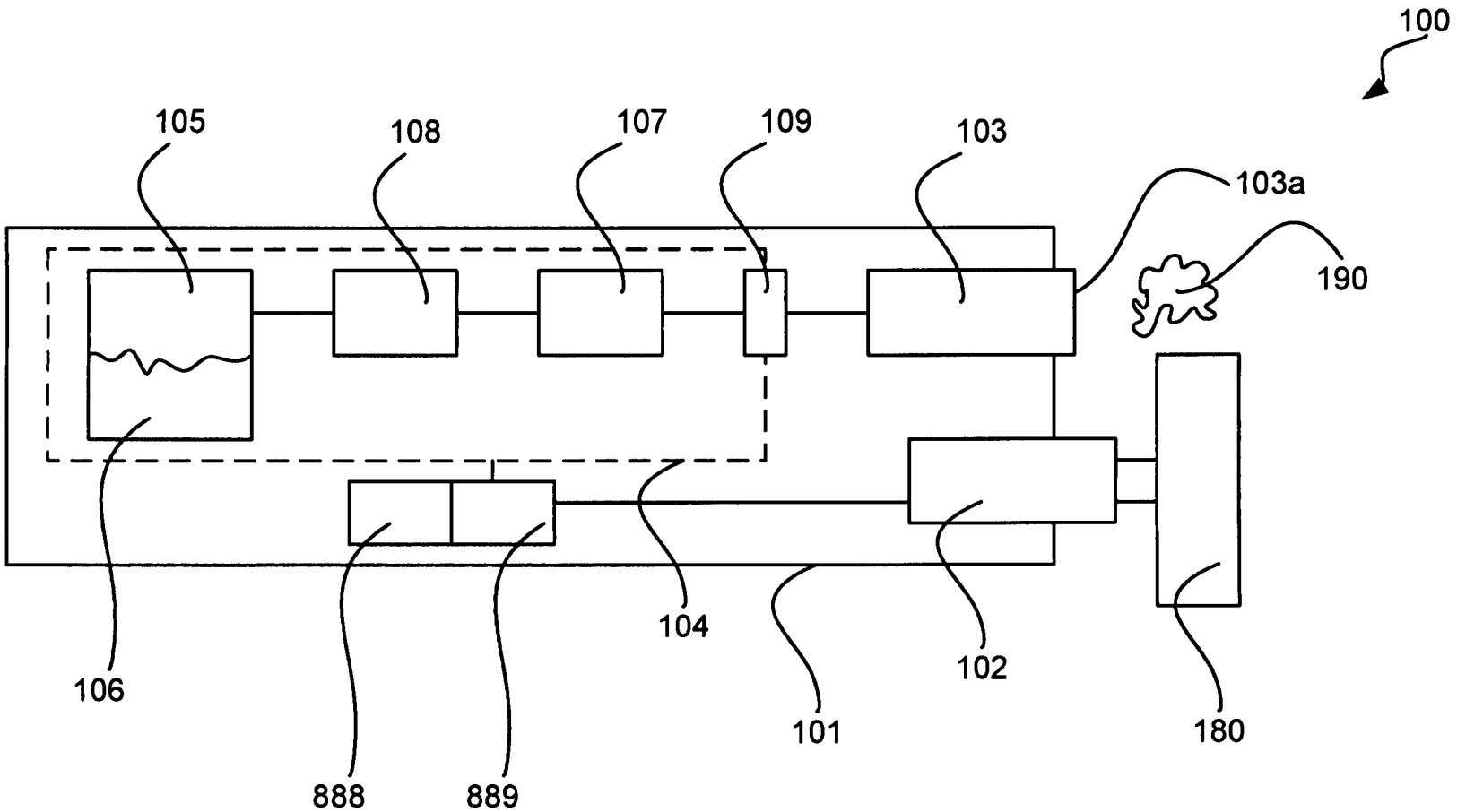
FIG. 1*a* illustrates a toy vehicle in accordance with a preferred embodiment of the invention.

FIG. 1*a* illustrates a toy vehicle 100 in accordance with a preferred embodiment of the invention. The toy vehicle comprises a body 101 having at least a wheel 180 rotationally coupled with the body 101 for rotating with respect to the body 101. An electric motor 102 is coupled with the body 101 and the at least a wheel 180 for rotating the at least a wheel 180 with respect to the body 101. An exhaust tube 103 is coupled with the body 101 and having an aperture 103*a* disposed proximate the at least a wheel 180. A smoke generating unit 104 fluidly coupled with the exhaust tube 103 for generating a simulated smoke 190 for having the simulated smoke 190 exit the exhaust tube 103 at the aperture 103*a* and proximate the at least a wheel 180.

The smoke generating unit 104 comprises a reservoir 105 for containing a smoke fluid 106 for use in generating the simulated smoke 190. In addition, the smoke generating unit 104 comprises a heating element 107 fluidly coupled with the reservoir 105 for having the smoke fluid 106 being in controllable contact therewith for having the smoke fluid 106 heated to a temperature by the heating element 107 for facilitating the generating of the simulated smoke 190. Fluidly coupled between the reservoir 105 and the heating element 107 is a smoke actuator assembly 108. For example the smoke actuator assembly 108 is in the form of a pump. Optionally, the smoke generating unit 104 comprises a blowing system 109 for facilitating travel of the simulated smoke through the exhaust tube 103 and out from the aperture 103*a*. Of course, also a battery compartment 888 is provided for providing of electrical power to the motor 102 and actuators and to the smoke generating unit and a control circuit 889 is electrically coupled to the motors and actuators and to the smoke generating unit 104. The smoke fluid 106 contains at least two of water and glycol and glycerin.

Figure 1B:
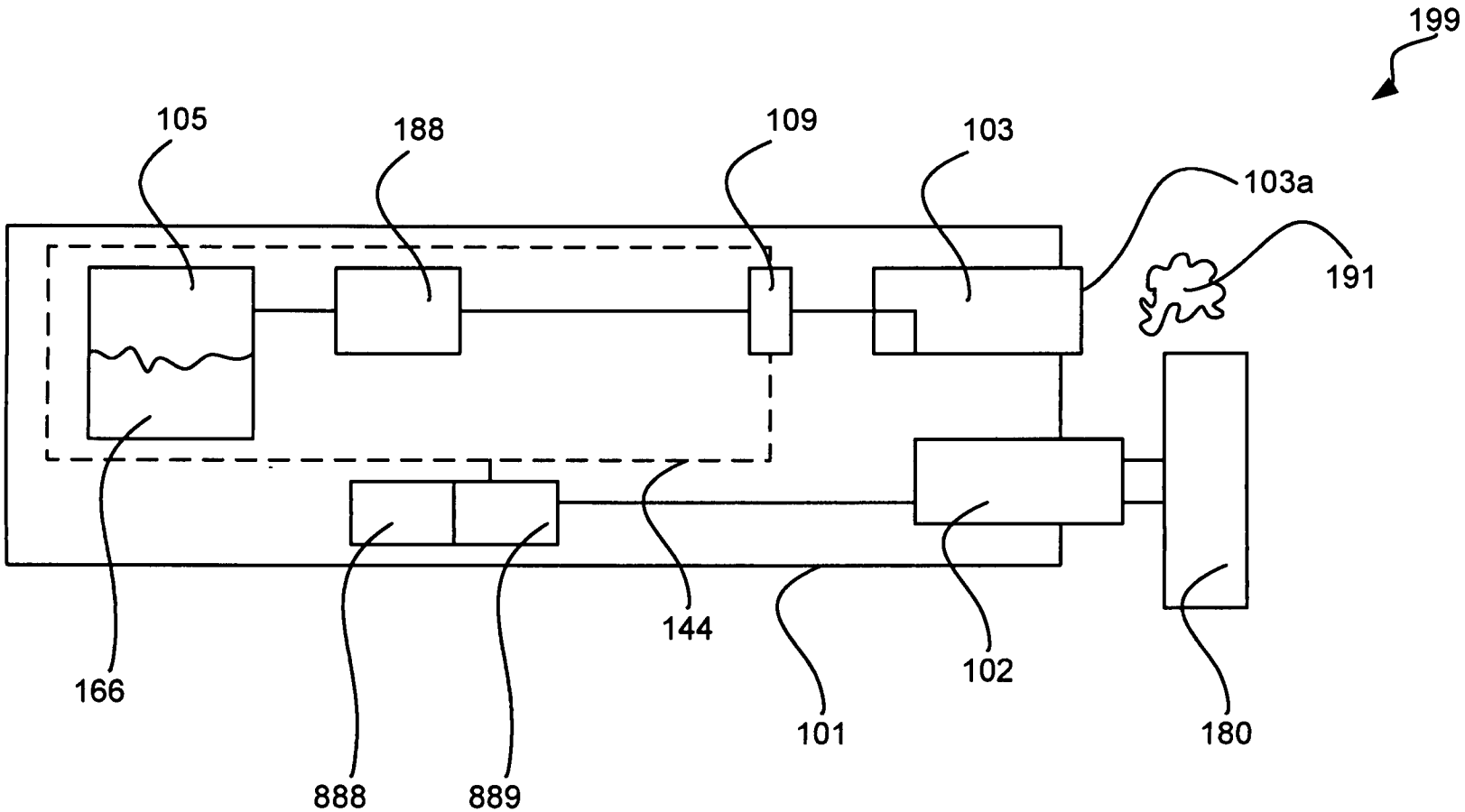
FIG. 1*b* illustrates a toy vehicle in accordance with another embodiment of the invention.

FIG. 1*b* illustrates a toy vehicle 199 in accordance with another embodiment of the invention. In this embodiment a smoke generating unit 144 comprises a reservoir 105 for containing a liquid 166, such as water, for use in generating the simulated smoke 190. In addition, the smoke generating unit 104 comprises an ultrasonic water fogger 188, or ultrasonic humidifier, that is fluidly coupled with the reservoir 105 for having the liquid 166 being in controllable contact therewith for having the liquid 166 transformed into a mist through the operation of the ultrasonic water fogger 188, the operation of the ultrasonic water fogger being well known to those of skill in the art, the mist, or fog, then represents a simulated smoke 191. Referring to FIGS. 1*a* and 1*b*, the toy vehicle, 100 and 199, is preferably in the form of a motorcycle.

Figure 1C:
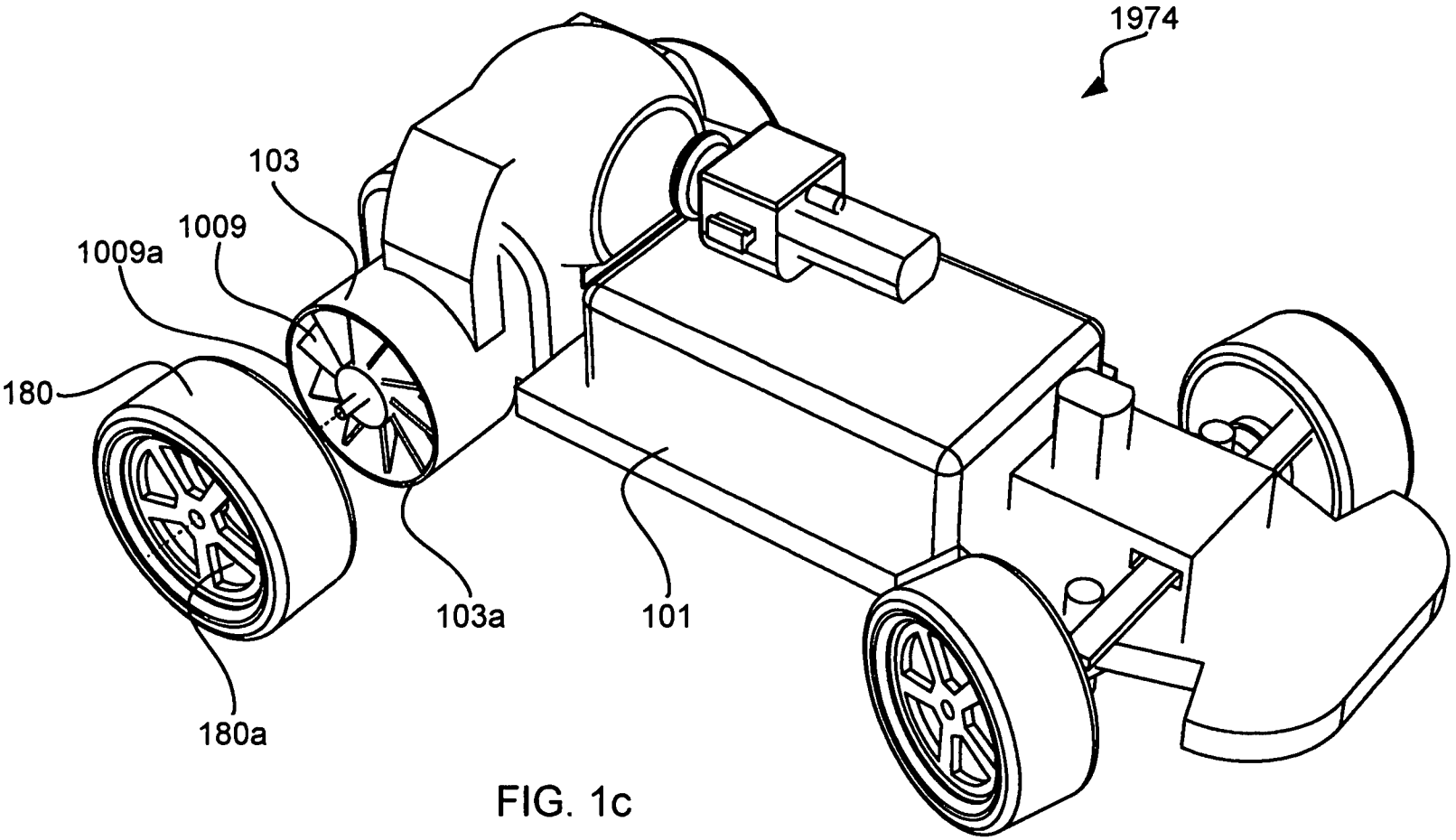
FIG. 1*c* illustrates a toy vehicle in accordance with the embodiment of the invention.

Referring to FIG. 1*c*, a toy vehicle 1974 is shown having four wheels in accordance with the embodiments of the invention, where optionally the blowing system 109 is in the form of a suction system 1009, where a propeller 1009*a* is disposed inside the at least a wheel 180 (shown adjacent for clarity) proximate the aperture 103*a* and coupled with the at least a wheel 180 for rotating with respect to the body 101 so that when the at least a wheel 180 rotates, the smoke 190 (not shown in this FIG) is sucked from the exhaust tube 103 and vented through a hub 180*a* of the at least a wheel 180. In this case the blowing system 109 is replaced with by the suction system 1009, where in this embodiment the propeller 1009*a* is disposed at the aperture 103*a* of the exhaust tube 103.

Figure 2A:
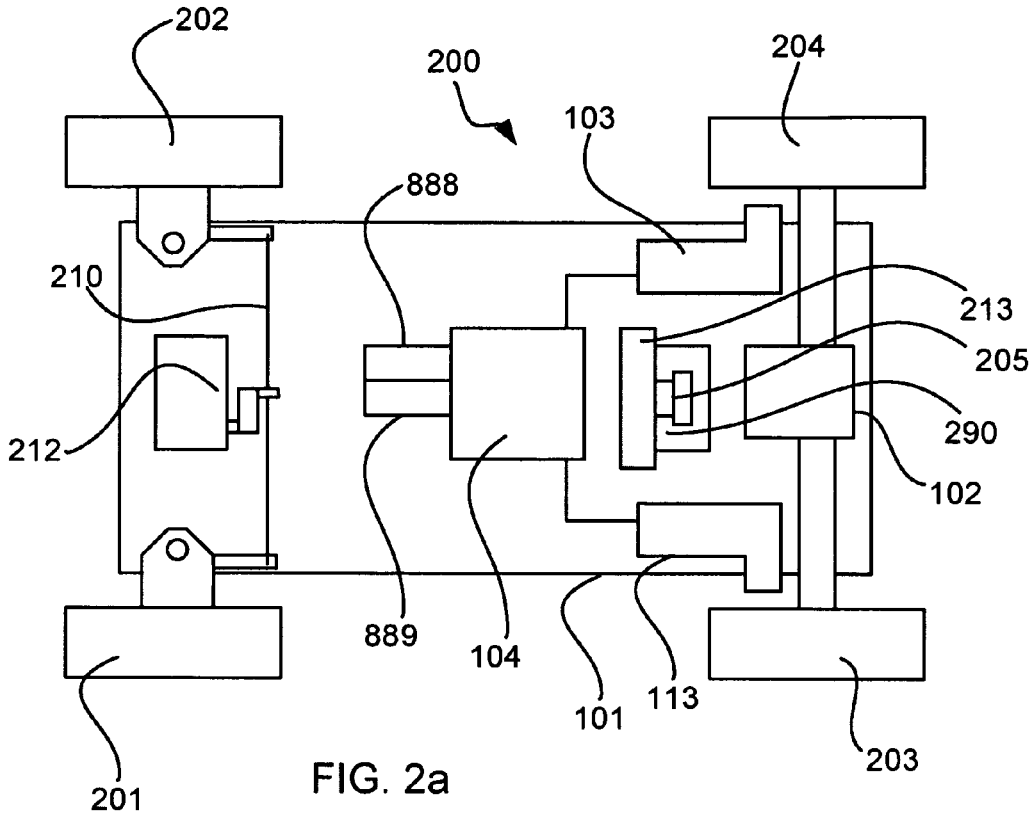
FIG. 2*a* illustrates a toy vehicle in accordance with the embodiments of the invention.
Figure 2B:
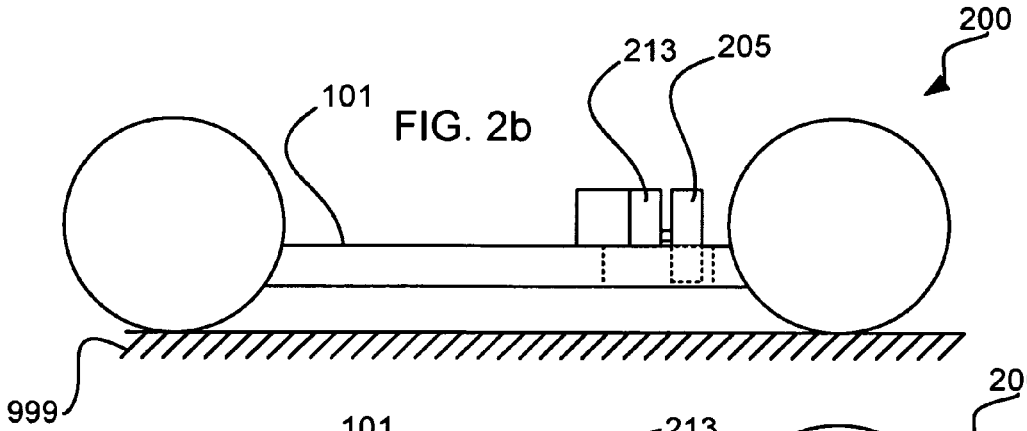
FIG. 2*b* illustrates the toy vehicle being in a first mode of operation.
Figure 2C:
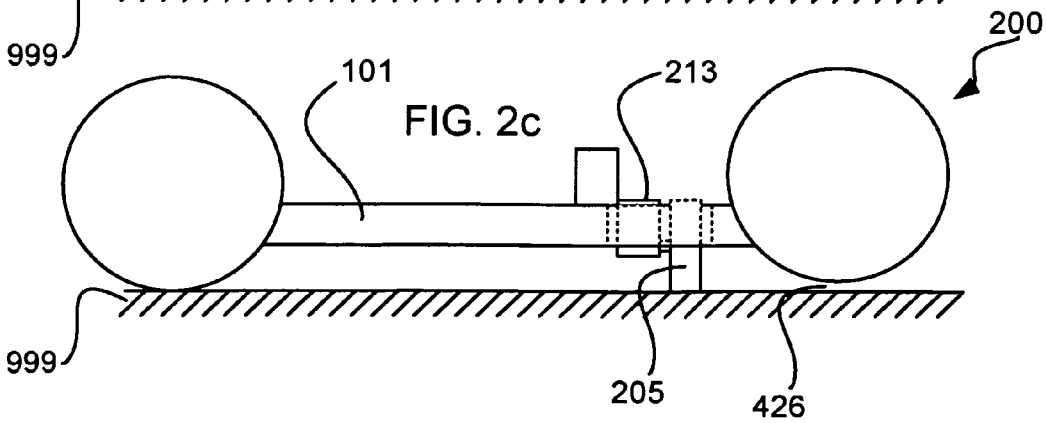
FIG. 2*c* illustrates the toy vehicle being in a second mode of operation.

FIG. 2*a* illustrates a toy vehicle 200 in accordance with the embodiments of the invention and having four wheels comprising a first wheel 201, a second wheel 202, a third wheel 203 and a fourth wheel 204 for contacting the ground 999 (FIGS. 2*b* and 2*c*), a motor 102 is coupled to the third wheel 203 and fourth wheel 204. A steering assembly is 210 coupled with the first wheel 201 and second wheel 202. A steering actuator 212 is coupled to the steering assembly 210 for actuating the first and second wheels, 201 and 202, to perform steering of the vehicle 200. Coupled with the body 101 is a second motor 213, or actuator, comprising a fifth wheel 205, where the fifth wheel protrudes from the body 101 through an aperture 290. The fifth wheel 205 is for in a first mode of operation of the toy vehicle 200, as shown in FIG. 2*c*, for contacting the ground 999 and in a second mode of operation, as shown in FIG. 2*b*, for other than contacting the ground 999. Preferably, in order to save on the cost of the motors, the fifth wheel 205 is controllably actuated between the first and second mode of operation using the smoke actuator assembly 108. Preferably for a four wheel vehicle, a second exhaust tube 113 is disposed proximate the third wheel and the exhaust tube 103 is disposed proximate the fourth wheel 204. Both exhaust tubes are fluidly coupled with the smoke generating unit 104. When the fifth wheel 205 is contacting the ground, the third and fourth wheels 203 and 204 are other than contacting the ground 999 and form a gap 426 between the wheels 203 and 204 and the ground 999, this facilitates the third and fourth wheels, 203 and 204, to free spin. As the wheels 203 and 204 free spin, the simulated smoke 190 from the exhaust tubes preferably wraps around the third and fourth wheels 203 and 204 to provide a visual simulation of the vehicle 200 performing a burnout, such as a drift car.

Figure 3A:
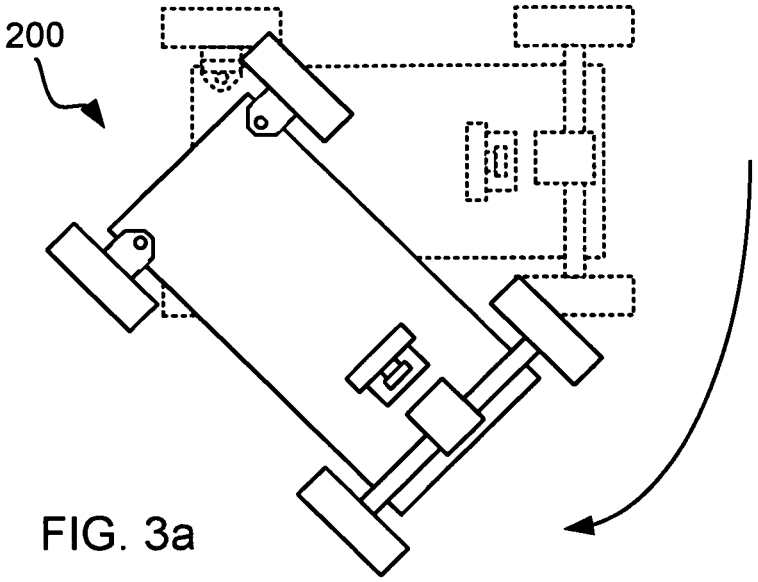
FIG. 3*a* illustrates a fifth wheel for contacting the ground in the first mode of operation.
Figure 3B:
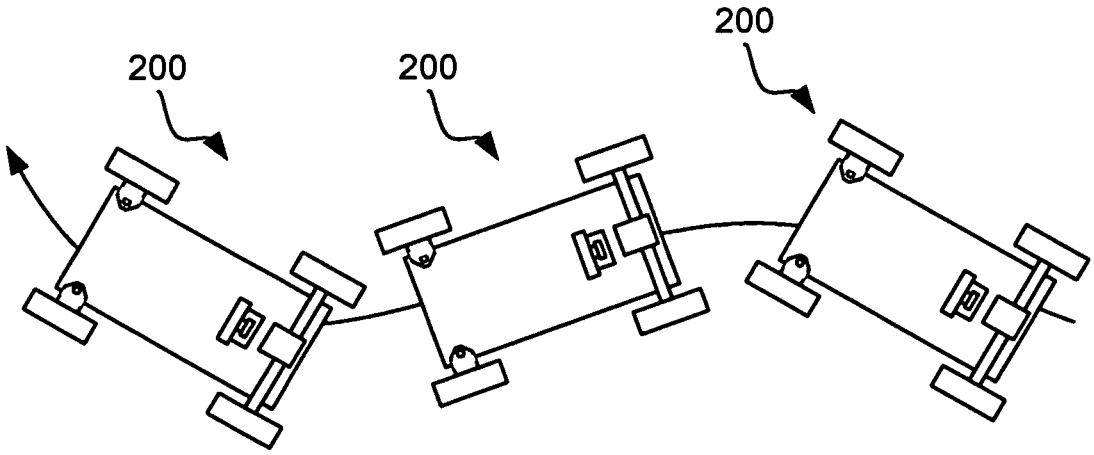
FIG. 3*b* illustrates the toy vehicle performing a fishtail operation as the fifth wheel is transitioned between the first and second modes of operation.

FIG. 3*a* illustrates the fifth wheel 290 contacting the ground 999 in the first mode of operation, whereby the result of this contacting of the ground causes the vehicle 200 to pivot approximately about the front wheels, 201 and 202, so that the vehicle 200 optionally spins. Potentially the rotation direction of the fifth wheel is varied such that the vehicle 200 performs a fishtail operation in conjunction with the motor 102 providing of rotation to the third and fourth wheels, 203 and 204, as is shown in FIG. 3*b*, where the fifth wheel 205 is transitioned between the first and second modes of operation. However in this case preferably an additional actuator is utilized for rotating of the fifth wheel 205.

Optionally a speaker is provided and the control circuit is coupled with the speaker for generating sounds therefrom.

Preferably the simulated smoke is released through the hub of the wheel or optionally through apertures in a hub of the wheel so that when the wheel turns the simulated smoke appears to wrap itself around the wheel so provide an appearance of the vehicle having a smoking tire function. Preferably a tire tread on an outside of the wheel comprises a pattern formed thereon that facilitates the simulated smoke to wrap itself about the outer surface of the tire.

Advantageously, the embodiments of the invention provide for a toy vehicle having a smoking tire function where during play of the toy vehicle the simulated smoke gives the toy vehicle an appearance of the toy vehicle performing a burnout, such as that which is seen as being performed by high horse powered drift cars, and as such increases a play value of the toy vehicle. But in this case the burnout is performed in a much safer manner because rubber is not being burnt and child safe and non-toxic chemicals are used for the simulated smoke or in the case of the water fogger, water vapor.

Numerous other embodiments may be envisaged without departing from the spirit or scope of the invention.

What is claimed is:

1. A remotely controlled toy vehicle capable of performing a fishtail or spin operation, the toy vehicle comprising:

a body;

first to fifth wheels rotationally coupled for contacting a ground and for rotating with respect to the body;

a first motor coupled between the fifth wheel and the body for rotating the fifth wheel with respect to the body for performing the fishtail or spin operation;

wherein in a first mode of operation, the fifth wheel contacts the ground, whereby the third and fourth wheels do not contact the ground, causing the toy vehicle to perform the fishtail or spin operation when the fifth wheel is rotated by the motor, and in a second mode of operation, the fifth wheel does not contact the ground, whereby the third and fourth wheels contact the ground;

an exhaust tube having an aperture disposed proximate the third or fourth wheels, or both; and a smoke generating unit fluidly coupled with the exhaust tube for generating simulated smoke wherein the simulated smoke exits the exhaust tube at the aperture and proximate the third or fourth wheels when the toy vehicle is performing the fishtail or spin operation.

2. A toy vehicle according to claim 1 wherein the smoke generating unit comprises a blowing system for inducing a discharge of simulated smoke through the exhaust tube.

3. A toy vehicle according to claim 1 wherein the smoke generating unit comprises a reservoir for containing smoke fluid for use in generating the simulated smoke.

4. A toy vehicle according to claim 3 wherein the smoke generating unit comprises a heating element configured for having the smoke fluid be in a controllable contact therewith for having the smoke fluid heated to a temperature for facilitating the generating of the simulated smoke.

5. A toy vehicle according to claim 4 wherein the smoke fluid comprises water and at least one of glycol and glycerin.

6. A toy vehicle according to claim 4 wherein the smoke generating unit comprises a smoke actuator assembly for actuating a controlled release of the smoke fluid for contacting the heating element.

7. A toy vehicle according to claim 1 wherein the smoke generating unit comprises an ultrasonic water fogger and a reservoir for containing water, wherein the ultrasonic water fogger is fluidly coupled with the reservoir for generating a fog when controllably contacted with the water and wherein the simulated smoke comprises water vapor.

8. A toy vehicle according to claim 1 comprising a blowing system for facilitating travel of the simulated smoke through the exhaust tube.

9. A toy vehicle according to claim 1 wherein the body of the toy vehicle resembles a car.

10. A toy vehicle according to claim 9 further comprising a second motor coupled to the third and fourth wheels;

a steering assembly coupled with the first and second wheels; and a steering actuator coupled to the steering assembly for actuating the first and second wheels to perform a steering operation.

11. A toy vehicle according to claim 1 comprising a control circuit coupled with the motor and the smoke generating unit, wherein the control circuit is coupled with a speaker for generating sound.

12. A toy vehicle according to claim 1 wherein the at least a wheel comprises a hub, the toy vehicle further comprising a propeller disposed proximate the aperture of the exhaust tube and coupled with the at least a wheel for rotating with respect to the body and for sucking the simulated smoke from the exhaust tube and venting it through the hub.

* * * * *